US011640780B2

(12) United States Patent
Jung et al.

(10) Patent No.: US 11,640,780 B2
(45) Date of Patent: May 2, 2023

(54) DATA DRIVER CIRCUIT CORRECTING SKEW BETWEEN A CLOCK AND DATA

(71) Applicant: LX SEMICON CO., LTD., Daejeon (KR)

(72) Inventors: Sung Wan Jung, Daejeon (KR); Sung Je Eom, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/545,481

(22) Filed: Dec. 8, 2021

(65) Prior Publication Data

US 2022/0189370 A1 Jun. 16, 2022

(30) Foreign Application Priority Data

Dec. 15, 2020 (KR) ..... 10-2020-0175283

(51) Int. Cl.
*G09G 3/20* (2006.01)

(52) U.S. Cl.
CPC ..... *G09G 3/20* (2013.01); *G09G 2300/0814* (2013.01); *G09G 2310/027* (2013.01); *G09G 2310/0286* (2013.01); *G09G 2310/0291* (2013.01); *G09G 2310/08* (2013.01); *G09G 2330/021* (2013.01)

(58) Field of Classification Search
CPC ..... G09G 3/30; G09G 3/32; G09G 3/3208; G09G 3/3216; G09G 3/3225; G09G 3/3233; G09G 3/3241; G09G 3/3283; G09G 3/3291; G09G 3/36; G09G 3/3611; G09G 3/3614; G09G 3/3622; G09G 3/3625; G09G 3/3685; G09G 3/3688; G09G 3/3692; G09G 2310/0286; G09G 2310/0289; G09G 2310/0291; G09G 2310/0294
USPC ..... 345/76–83, 87–104
See application file for complete search history.

(56) References Cited

U.S. PATENT DOCUMENTS 4,556,947 A * 12/1985 Prioste ..... G01R 31/31926 326/39
6,377,235 B1 * 4/2002 Murade ..... G09G 3/3688 345/100
7,317,775 B1 * 1/2008 Erhart ..... H03L 7/0812 375/360

(Continued)

FOREIGN PATENT DOCUMENTS

KR 10-2260328 B1 5/2016

*Primary Examiner* — Alexander Eisen
*Assistant Examiner* — Nelson Lam
(74) *Attorney, Agent, or Firm* — Harness, Dickey & Pierce, P.L.C.

(57) ABSTRACT

The present disclosure relates to a data driver circuit capable of overcoming a limitation in frequency by correcting a skew between a clock and data even when a frequency and the number of channels are increased, and the data driver circuit according to an aspect may include a shift register configured output sampling signals in response to a clock, a first latch part configured to sample and latch data of each channel in response to each of the sampling signals, and a bi-directional deskew buffer part disposed between a stage of a first channel and a stage of a second channel belonging to the shift register and between a first latch of a first channel and a second latch of a second channel belonging to the first latch part and configured to buffer a clock input from the stage of the first channel.

17 Claims, 11 Drawing Sheets

(56) References Cited

U.S. PATENT DOCUMENTS

| | | | | |
|---|---|---|---|---|
| 8,362,996 | B2 | 1/2013 | Huang et al. | |
| 2002/0112099 | A1* | 8/2002 | Collier | H04L 25/14 710/1 |
| 2004/0252112 | A1* | 12/2004 | Fukuda | G09G 3/3611 345/204 |
| 2007/0035500 | A1* | 2/2007 | Takeo | G09G 3/3688 345/98 |
| 2008/0001944 | A1* | 1/2008 | Chang | G09G 3/3688 345/214 |
| 2010/0060557 | A1* | 3/2010 | Hsu | G09G 3/3688 345/87 |
| 2013/0127813 | A1* | 5/2013 | Lee | G09G 5/18 345/212 |
| 2015/0042395 | A1* | 2/2015 | Yang | G09G 3/20 327/333 |

* cited by examiner

DATA DRIVER CIRCUIT CORRECTING SKEW BETWEEN A CLOCK AND DATA

CROSS-REFERENCE TO RELATED APPLICATIONS

This application claims the benefit of the Korean Patent Application No. 10-2020-0175283 filed on Dec. 15, 2020, which is hereby incorporated by reference as if fully set forth herein.

FIELD OF THE INVENTION

The present disclosure relates to a data driver circuit capable of correcting a skew between a clock and data even when a frequency and the number of channels are increased.

BACKGROUND

Display devices include a panel configured to display an image through a pixel matrix, a gate driver circuit configured to drive gate lines of the panel, a data driver circuit configured to supply a data signal to data lines of the panel, a timing controller configured to control the gate driver circuit and the data driver circuit, and the like.

The data driver circuit may sequentially latch image data supplied from the timing controller for each horizontal period, simultaneously convert the pieces of latched data of each horizontal line into analog data signals, and individually output the converted data signals to the data lines of the panel.

As the display devices are developed toward having high resolution, a driving frequency of the data driver circuit and the number of output channels need to be increased.

However, when a length of a chip increases due to the increase of the number of output channels, a length of a data path in a channel area increases to cause a skew problem between a clock and data to occur, resulting in a data sampling error, and thus there is a limitation in increasing the frequency.

SUMMARY

The present disclosure is directed to providing a data driver circuit capable of overcoming a limitation in frequency by correcting a skew between a clock and data even when a frequency and the number of channels are increased.

According to an aspect of the present disclosure, there is provided a data driver circuit including a shift register configured output sampling signals in response to a clock, a first latch part configured to sample and latch data of each channel in response to each of the sampling signals, and a bi-directional deskew buffer part disposed between a stage of a first channel and a stage of a second channel belonging to the shift register and between a first latch of a first channel and a first latch of a second channel belonging to the first latch part, and configured to buffer a clock input from the stage of the first channel to output the buffered clock to the stage of the second channel, and buffer and latch data of the second channel input after data of the first channel, which is latched by the first latch of the first channel, in synchronization with the buffered clock to output the latched data to the first latch of the second channel.

The bi-directional deskew buffer part may include a clock buffer configured to buffer the clock supplied from the stage of the first channel of the shift register and output the buffered clock to the stage of the second channel, and a data buffer part configured to buffer and latch the data of the second channel input through the first latch of the first channel of the first latch part in synchronization with the clock output from the clock buffer, and output the latched data to the first latch of the second channel.

Each of the clock buffer, and data buffers of a plurality of bits constituting the data buffer part may include an input switch part including a first switch and a second switch connected in series between a first supply line and a second supply line and configured to determine an input direction or a latch operation, an output switch part including a third switch and a fourth switch connected in series between the first and second supply lines and configured to determine an output direction or the latch operation, and a buffer part connected between a first connection node between the first and second switches and a second connection node between the third and fourth switches.

The shift register and the first latch part may be divided into a plurality of channel blocks, and the bi-directional deskew buffer part may be disposed between the plurality of channel blocks. The plurality of channel blocks of the shift register and the first latch part, and the bi-directional deskew buffer part between the plurality of channel blocks may be sequentially activated from an inactivated state. When the first latch part latches all pieces of data of the plurality of channel blocks, the plurality of channel blocks and the bi-directional deskew buffer part may be inactivated.

The data driver circuit may further include a second latch part configured to simultaneously receive and latch pieces of data of a plurality of channels, which are latched in the first latch part, and output the latched pieces of data in response to a load signal, wherein the clock buffer of the bi-directional deskew buffer part may be enabled in response to a carry signal received from the stage of the first channel of the shift register and may be disabled in response to the load signal of the second latch part, and the data buffer part of the bi-directional deskew buffer part may be enabled or disabled according to an output of the clock buffer.

The clock buffer may include an input switch part including a 1Ath switch and a 2Ath switch connected in series between a first clock supply line connected to the stage of the first channel of the shift register and a second clock supply line connected to the stage of the second channel of the shift register, an output switch part including a 3Ath switch and a 4Ath switch connected in series between the first and second clock supply lines, a buffer part connected between a 1Ath connection node between the 1Ath and 2Ath switches and a 2Ath connection node between the 3Ath and 4Ath switches, and an SR latch circuit configured to receive and latch the carry signal received from the stage of the first channel and the load signal respectively as a set signal and a reset signal and output the set signal and the reset signal to the buffer part.

The buffer part of the clock buffer may include a 1Ath inverter connected to the 1Ath connection node, and a NAND gate circuit configured to receive an output of the 1Ath inverter and an output of the SR latch circuit, perform a NAND gate logic operation, and output an operation result to the 2Ath connection node, and may further include a 2Ath inverter configured to receive an output of the 2Ath connection node, generate a data enable signal, and output the data enable signal to the data buffer.

Each of the data buffers of a plurality of bits constituting the data buffer part may include an input switch part including a 1Bth switch and a 2Bth switch connected in series between a first data supply line connected to a data bus passing through the first latch of the first channel and a second data supply line connected to the first latch of the second channel, an output switch part including a 3Bth switch and a 4Bth switch connected in series between the first and second data supply lines, and a buffer part including a 1Bth inverter and a 2Bth inverter connected in series between a 1Bth connection node between the 1Bth and 2Bth switches and a 2Bth connection node between the 3Bth and 4Bth switches.

The data driver circuit may include a channel area in which the shift register, the first latch part, the bi-directional deskew buffer part, a second latch part, a digital-to-analog converter, and an output buffer part are disposed, an output pad area configured to output data signals supplied from the channel area to a plurality of output channels, an input pad area configured to receive a transmission signal, a receiver disposed adjacent to the input pad area, and configured to receive the transmission signal through the input pad area, and recover the clock, the data, and a control signal from the received transmission signal to output the recovered clock, data, and control signal, and a logic controller disposed adjacent to and between the receiver and the channel area, and configured to transmit the clock and the control signal supplied from the receiver to the channel area and rearrange the data for each channel to supply the data to the channel area.

The logic controller may include a first logic controller and a second logic controller disposed respectively adjacent to both side surface portions of the channel area with the channel area therebetween. The receiver may include a first receiver and a second receiver disposed respectively adjacent to the first and second logic controllers. The input pad area may include a first input pad area and a second input pad area disposed on both side surface portions of the data driver circuit to be adjacent to the first and second receivers, respectively. The output pad area may be disposed at a lower end portion of each of the input pad area, the receiver, the logic controller, and the channel area.

According to another aspect of the present disclosure, there is provided a data driver circuit including a bi-directional deskew buffer part disposed between a stage of a first channel and a stage of a second channel belonging to a shift register and between a first latch of a first channel and a first latch of a second channel belonging to a first latch part, wherein the bi-directional deskew buffer part may include a clock buffer configured to buffer a clock input from the stage of the first channel and output the buffered clock to the stage of the second channel, and a data buffer part configured to buffer and latch data of the second channel input after data of the first channel, which is latched by the first latch of the first channel, in synchronization with a clock output from the clock buffer, and output the latched data to the first latch of the second channel.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
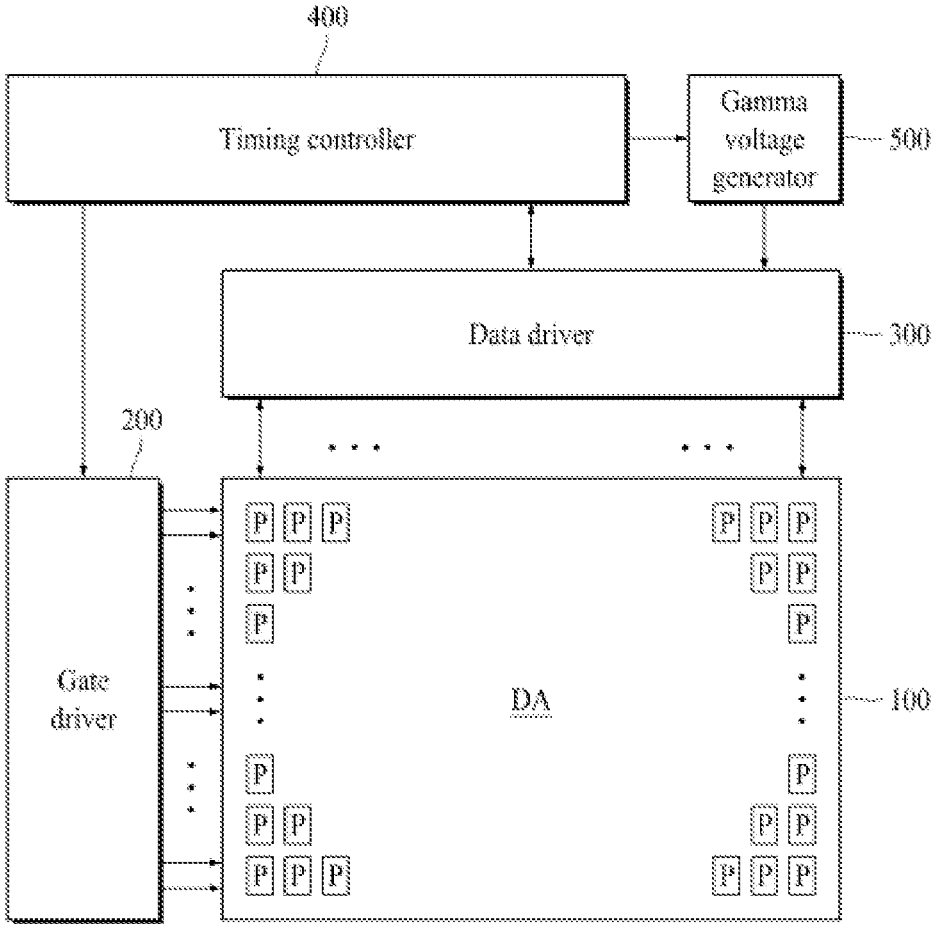
FIG. 1 is a block diagram illustrating a configuration of a display device according to one embodiment.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a position relationship, for example, when a position relation between two parts is described as "on," "over," "under," and "next," one or more other parts may be disposed between the two parts unless a more limiting term, such as "just" or "direct(ly)" is used.

In describing a time relationship, for example, when the temporal order is described as, for example, "after," "subsequent," "next," and "before," a case which is not continuous may be included unless a more limiting term, such as "just," "immediate(ly)," or "direct(ly)" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, the terms "first," "second," "A," "B," "(a)," "(b)," etc., may be used. These terms are intended to identify the corresponding elements from the other elements, and basis, order, or number of the corresponding elements should not be limited by these terms. The expression that an element is "connected," "coupled," or "adhered" to another element or layer, the element or layer can not only be directly connected or adhered to another element or layer, but also be indirectly connected or adhered to another element or layer with one or more intervening elements or layers "disposed" between the elements or layers, unless otherwise specified.

The term "at least one" should be understood as including any and all combinations of one or more among the associated listed elements. For example, the meaning of "at least one or more of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, exemplary embodiments of the present disclosure will be described in detail with reference to the drawings.

Figure 2:
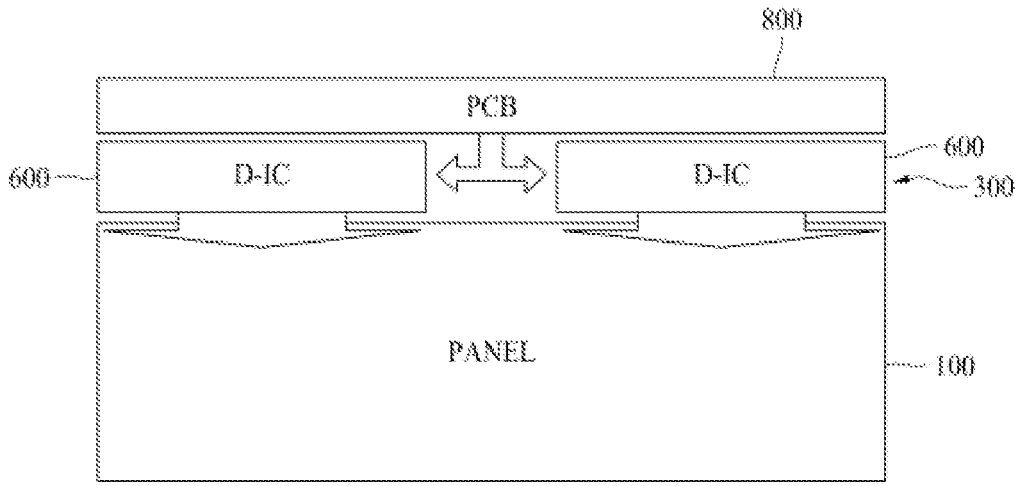
FIG. 2 is a block diagram illustrating a display device having data driver integrated circuits (ICs) according to one embodiment.
Figure 3:
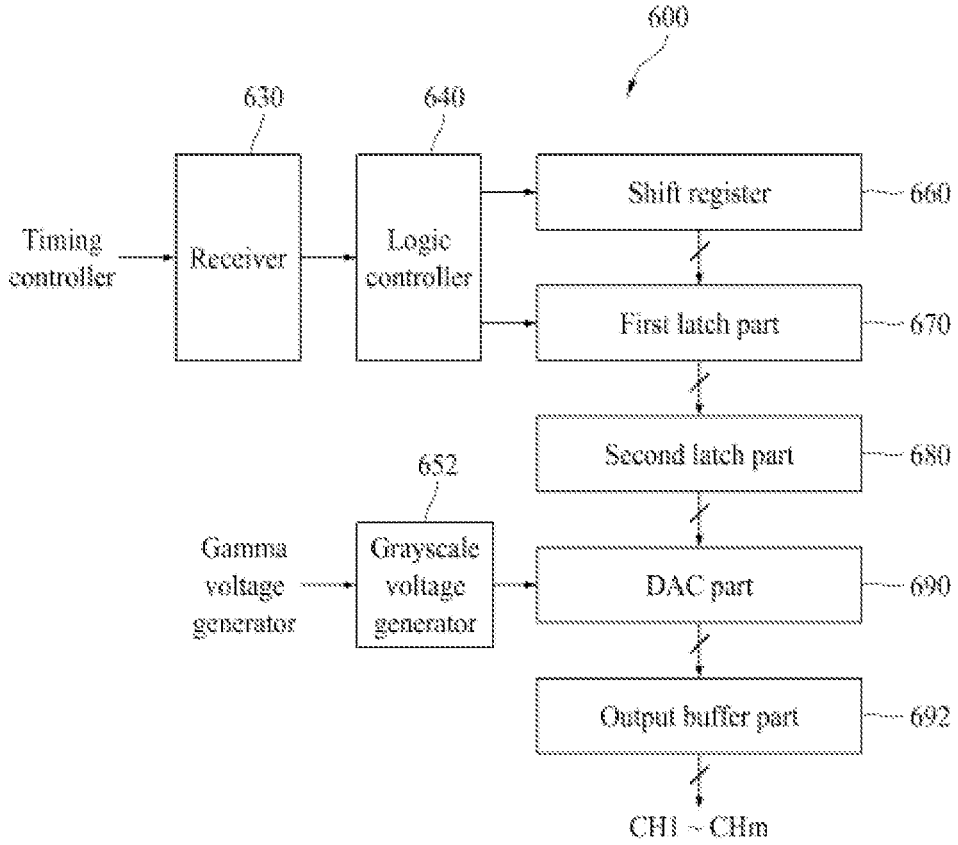
FIG. 3 is a block diagram illustrating an internal configuration of the data driver IC according to one embodiment.
Figure 4:
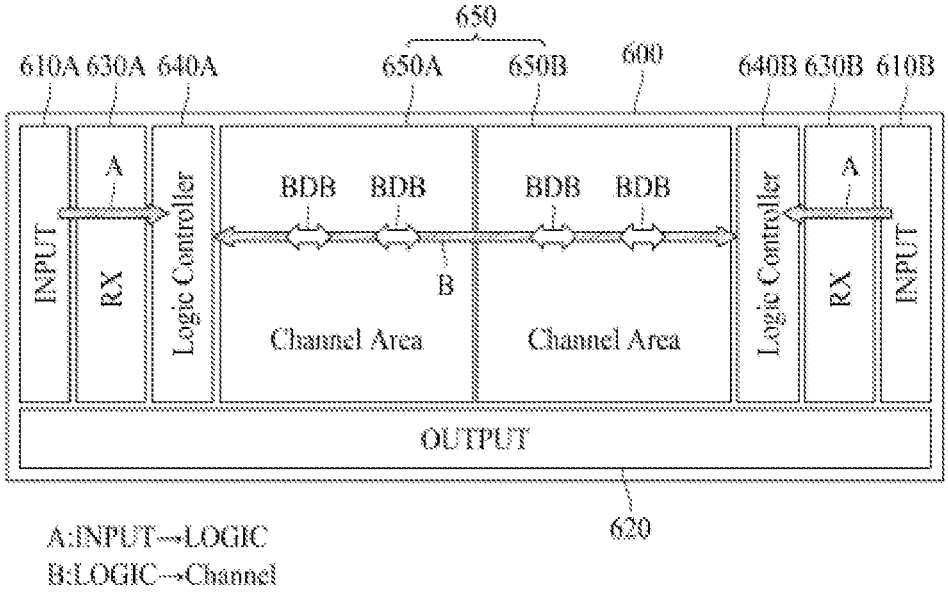
FIG. 4 is a block diagram illustrating an arrangement structure of the data driver IC according to one embodiment.

FIG. 1 is a block diagram schematically illustrating a configuration of a display device according to one embodiment, FIG. 2 is a diagram illustrating a display device having a plurality of data driver integrated circuits (ICs) according to one embodiment, FIG. 3 is a block diagram illustrating an internal configuration of the data driver IC according to one embodiment, and FIG. 4 is a block diagram illustrating an arrangement structure of the data driver IC according to one embodiment.

The display device according to one embodiment may be any one of various display devices including a liquid crystal display device, an electroluminescent display device, a micro light-emitting diode (LED) display device, and the like. The electroluminescent display device may be an organic light-emitting diode (OLED) display device, a quantum-dot light-emitting diode display device, or an inorganic light-emitting diode display device.

Referring to FIG. 1, the display device may include a display panel 100, a gate driver 200, a data driver 300, a gamma voltage generator 500, a timing controller 400, and the like. The gate driver 200 and the data driver 300 may be defined as panel drivers. The gate driver 200, the data driver 300, and the timing controller 400 may be defined as display drivers.

The display panel 100 displays an image through a display area DA in which sub-pixels P are arranged in a matrix form. Each of the sub-pixels P is one of a red sub-pixel emitting red light, a green sub-pixel emitting green light, a blue sub-pixel emitting blue light, and a white sub-pixel emitting white light, and is independently driven by at least one thin-film transistor (TFT). A unit pixel may be configured of a combination of two, three, or four sub-pixels having different colors.

A gate electrode of the TFT belonging to each of the sub-pixels P is connected to the gate driver 200 through a gate line disposed on the display panel 100, and an input electrode of any one of a source electrode and a drain electrode of each TFT is connected to the data driver 300 through a data line disposed on the display panel 100.

In other words, in each of the sub-pixels P, while the TFT is turned-on in response to a scan pulse of a gate-on voltage, which is supplied through the corresponding gate line from the gate driver 200, a pixel voltage (driving voltage) corresponding to the data signal is charged by receiving the data signal, which is supplied through the corresponding data line from the data driver 300, through the turned-on TFT and light corresponding to the charged voltage is emitted, so that a grayscale corresponding to the data signal may be expressed.

The display panel 100 may further include a touch sensor screen entirely overlapping the display area and configured to sense a touch of a user, and the touch sensor screen may be embedded in the panel 100 or disposed in the display area of the panel 100.

The timing controller 400 may receive image data and synchronization signals from a host system (not shown). For example, the host system may be any one of a computer, a TV system, a set-top box, a system of a portable terminal such as a tablet or mobile phone. The synchronization signals may include a dot clock, a data enable signal, a vertical synchronization signal, a horizontal synchronization signal, and the like.

The timing controller 400 may generate a plurality of data control signals to supply the plurality of data control signals to the data driver 300 using the received synchronization signals and timing setting information (start timing, a pulse width, and the like) stored in an internal register, and generate a plurality of gate control signals to supply the plurality of gate control signals to the gate driver 200.

The timing controller 400 may perform various types of image processing such as brightness correction for reducing power consumption, image quality correction, and the like on the supplied image data, and supply the image-processed data to the data driver 300.

The gamma voltage generator 500 may generate a reference gamma voltage set including a plurality of reference gamma voltages having different voltage levels and supply the reference gamma voltage set to the data driver 300. The gamma voltage generator 500 may generate the plurality of reference gamma voltages corresponding to gamma characteristics of the display device under the control of the timing controller 400 and supply the reference gamma voltages to the data driver 300. The gamma voltage generator 500 may include a programmable gamma IC, and may receive gamma data from the timing controller 400, generate or adjust a reference gamma voltage level according to the gamma data, and output the reference gamma voltage level to the data driver 300.

The gate driver 200 is controlled according to the plurality of gate control signals supplied from the timing controller 400 to individually drive the gate lines of the display panel 100. The gate driver 200 may sequentially drive a plurality of gate lines. The gate driver 200 may supply a scan signal of a gate-on voltage to the corresponding gate line in a driving period of each of the gate lines, and supply the scan signal of a gate-off voltage to the corresponding gate line in a non-driving period of each of the gate lines.

The gate driver 200 may include at least one gate driver IC, and may be mounted on a circuit film such as a tape carrier package (TCP), a chip on film (COF), a flexible printed circuit (FPC), or the like to be attached to the display panel 100 in a tape automatic bonding (TAB) manner, or may be mounted on the display panel 100 in a chip on glass (COG) manner. Alternatively, the gate driver 200 may be formed on a TFT substrate together with the TFT belonging to each of the sub-pixels P of the display panel 100 and embedded in a bezel area of the display panel 100.

The data driver 300 may be controlled according to the data control signal supplied from the timing controller 400, and may convert the digital image data supplied from the timing controller 400 into an analog data signal and supply the analog data signal to each of the data lines of the display panel 100. The data driver 300 may convert the digital image data into the analog data signal using grayscale voltages obtained by subdividing the plurality of reference gamma voltages supplied from the gamma voltage generator 500.

The data driver 300 may include at least one data driver IC and may be mounted on a circuit film such as a TCP, a COF, an FPC, or the like to be attached to the display panel 100 in a TAB manner, or may be mounted in the bezel area of the display panel 100 in a COG manner.

Referring to FIG. 2, the data driver 300 may include a plurality of data driver ICs (D-ICs) 600, and may be located between a printed circuit board (PCB) 800, on which the timing controller 400 (FIG. 1) and the gamma voltage generator 500 (FIG. 1) are mounted, and the display panel 100 and connected to the PCB 800 and display panel 100.

Each of the plurality of data driver ICs 600 may receive a transmission signal, which is supplied from the PCB 800, through any one of input parts respectively located on both left and right side surface portions thereof, and may output data signals to the display panel 100 through an output part located at a lower end portion thereof. Meanwhile, in each of the data driver ICs 600, the input part may be located on one side surface portion rather than on both side surface portions, or may be located on an upper end portion.

Referring to FIG. 3, each of the data driver ICs 600 may include a receiver 630, a shift register 660, latch parts 670 and 680, a grayscale voltage generator 652, a digital to analog converter (DAC) part 690, and an output buffer part 692.

Each of the data driver ICs 600 may supply a corresponding data signal to m (where m is a positive integer) data lines among the data lines disposed on the display panel 100 through m output channels CH1 to CHm.

In each of the data driver ICs 600, the shift register 660, the latch parts 670 and 680, the DAC part 690, and the output buffer part 692 may be disposed in a channel area, and the shift register 660, the latch parts 670 and 680, the DAC part 690, and the output buffer part 692 may include m channels equal to the number of the output channels CH1 to CHm.

In order to reduce the number of transmission lines and reduce electromagnetic interference (EMI), the timing controller 400 and the plurality of data driver ICs 600 may use a high-speed serial interface method in which image data and control signals are converted into serial transmission signals in which a clock is embedded and transmitted and received in a point-to-point manner. To this end, the timing controller 400 includes a transmitter, and each of the plurality of data driver ICs 600 includes the receiver 630. The timing controller 400 may transmit the transmission signal in the form of a differential signal, such as a low voltage differential signal (LVDS), through at least one pair of transmission channels individually connected to the plurality of data driver ICs 600.

The receiver 630 of each data driver IC 600 may receive the transmission signals in the form of a differential signal supplied from the timing controller 400 in a high-speed serial interface method, recover a clock from the received differential signal and also recover digital image data and control signals using the recovered clock, and output the recovered digital image data and control signals to a logic controller 640.

The logic controller 640 may convert the image data supplied from the receiver 630 into a parallel form of each sub-pixel unit, rearrange the data of each sub-pixel according to an operation option, and output the rearranged data to a first latch part 670. The logic controller 640 may output a start pulse and a clock signal to the shift register 660 using the clock and data control signals supplied from the receiver 630, output a load signal to a second latch part 680 and the output buffer part 692, and may further generate and output control signals necessary for the operations of other components.

The shift register 660 may sequentially output a plurality of sampling signals to the first latch part 670 while sequentially shifting the start pulse according to the clock signal. The shift register 660 may include stages of a plurality of channels and sequentially output sampling signals of a plurality of channels to the first latch part 670 while performing a shift operation for sequentially shifting the start pulse according to the clock signal. The shift register 660 may include stages of m channels equal to the number of the output channels CH1 to CHm, and may include stages less than m stages.

The first latch part 670 may sequentially latch pieces of data of a plurality of channels, which are sequentially transmitted from the receiver 630 through a data bus, in response to the sampling signals of a plurality of channels, which are sequentially input from the shift register 660, for each channel of each sub-pixel unit, and when pieces of data of all channels are latched, the first latch part 670 may simultaneously output the latched data of each channel to the second latch part 680. The first latch part 670 may include first latches of m channels equal to the number of the output channels CH1 to CHm.

The second latch part 680 may simultaneously output the data of each channel (sub-pixel) received from the first latch part 670 to the DAC part 690 in response to the load signal supplied from the logic controller 640. The second latch part 680 may include second latches of m channels equal to the number of the output channels CH1 to CHm.

The grayscale voltage generator 652 may subdivide the reference gamma voltages supplied from the gamma voltage generator 500 into a plurality of grayscale voltages respectively corresponding to grayscale values of the image data by dividing the reference gamma voltages through a resistor string, and then output the subdivided grayscale voltages to the DAC part 690.

The DAC part 690 may convert the data of each subpixel supplied from the second latch part 680 into an analog data signal for each channel using the grayscale voltages supplied from the grayscale voltage generator 652, and output the analog data signals to the output buffer part 692. The DAC part 690 may include DACs of m channels equal to the number of the channels CH1 to CHm.

The output buffer part 692 may buffer the data signal of each sub-pixel, which is supplied from the DAC part 690, for each channel and output the buffered data signal to each of the plurality of output channels CH1 to CHm. The output buffer part 692 may include output buffers of m channels equal to the number of output channels CH1 to CHm.

Referring to FIG. 4, since the number of the output channels connected to the data lines of the display panel 100 is large, each of the data driver ICs 600 according to one embodiment may have a rectangular shape elongated in leftward and rightward directions, and an output pad area 620 may be disposed in a long area in the lower end portion of the data driver IC 600.

In order for left and right bi-directional driving, each of the data driver ICs 600 may include first and second input pad areas 610A and 6106 respectively disposed on left and right side surface portions thereof, and may include first and second receivers (RXs) 630A and 630B disposed respectively adjacent to the first and second input pad areas 610A and 6106, and first and second logic controllers 640A and 640B disposed respectively adjacent to the first and second receivers 630A and 630B. In addition, each of the data driver ICs 600 may include a channel area 650, which is disposed between the first and second logic controllers 640A and 640B and thus driven in both directions and connected to the output pad area 620 at the lower end portion thereof. The shift register 660, the latch parts 670 and 680, the DAC part 690, and the output buffer part 692, which are described with reference to FIG. 3, may be disposed in the channel area 650.

The data driver IC 600 may receive the transmission signal supplied from the timing controller 400 through one of the first and second input pad areas 610A and 610B according to an operation option.

The data driver IC 600 may convert the transmission signals input through the first input pad area 610A into data of each sub-pixel to be transmitted to the channel area 650 through an A data path (a first data path) passing through the first receiver 630A and the first logic controller 640A in a first direction. The data driver IC 600 may sequentially sample and latch the data of each sub-pixel for each channel through a B data path (a second data path) passing through a first channel area 650A and a second channel area 650B from the first logic controller 640A in the first direction, convert the latched data of each sub-pixel into a data signal, and output the data signal for each channel through the output pad area 620.

Meanwhile, the data driver IC 600 may convert the transmission signals input through the second input pad area 610B into data of each sub-pixel to be transmitted to the channel area 650 through the A data path (the first data path) passing through the second receiver 630B and second logic controller 640B in a second direction. The data driver IC 600 may sequentially sample and latch the data of each sub-pixel for each channel through the B data path (the second data path) passing through the second channel area 650B and the first channel area 650A from the second logic controller 640B in the second direction, convert the latched data of each sub-pixel into a data signal, and output the data signal for each channel through the output pad area 620.

In particular, in the data driver IC 600 according to one embodiment, in order to prevent a skew problem from occurring between a clock and data in the long channel area 650 as the number of output channels CH1 to CHm increases, a bi-directional deskew buffer (BDB) part configured to synchronize the data using the clock is applied to each of the plurality of channels of the shift register 660 and the first latch part 670 in the channel area 650 so that the skew generated between the clock and the data may be offset.

To this end, the BDB part may include a clock buffer that is a bi-directional deskew buffer for a clock and a data buffer part that is a bi-directional deskew buffer for data. The channel area 650 may be divided into a plurality of channel blocks, and the clock buffer and the data buffer part of the BDB part may be disposed between adjacent channel blocks. The clock buffer may buffer and output a clock in both directions, and the data buffer part may buffer and latch data so that the data is synchronized with the clock supplied from the clock buffer and output the data, thereby offsetting the skew between the clock and the data. A detailed description thereof will be made below.

Figure 5:
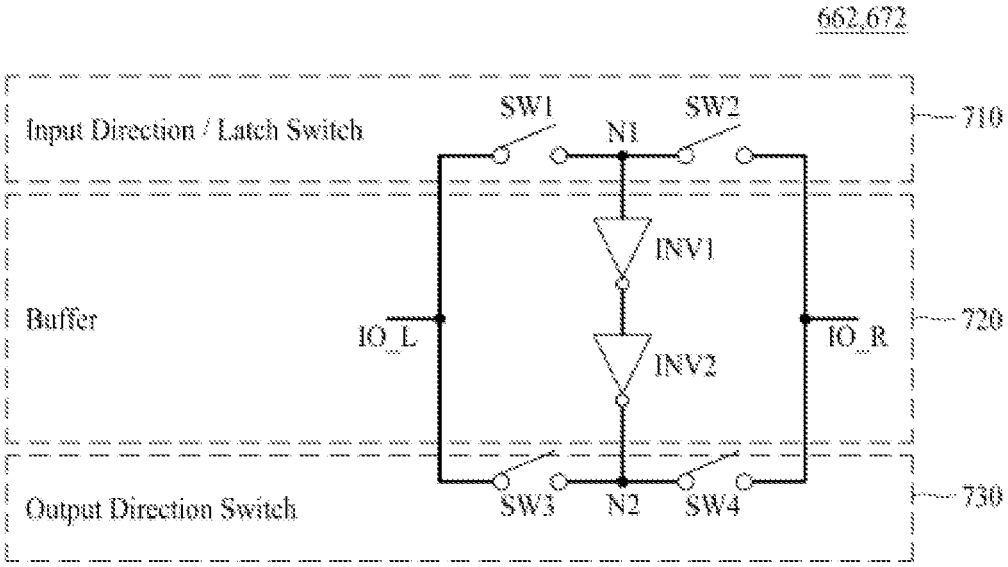
FIG. 5 is an equivalent circuit diagram illustrating an internal configuration of a bi-directional deskew buffer according to one embodiment.
Figure 6A:
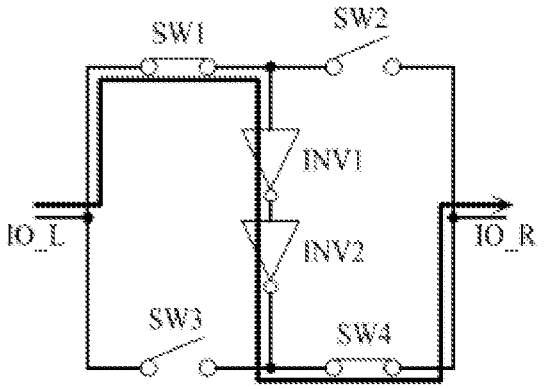
FIGS. 6A and 6B are diagrams illustrating a bi-directional buffering operation of the bi-directional deskew buffer according to one embodiment.
Figure 6B:
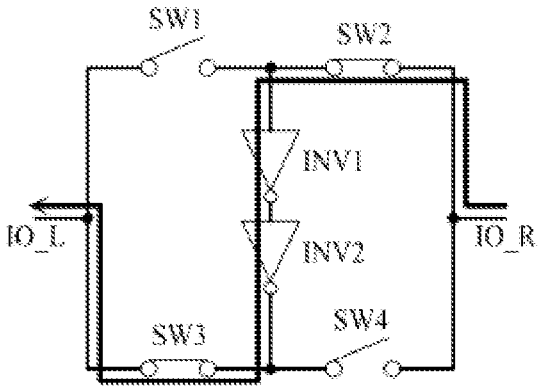
Figure 7A:
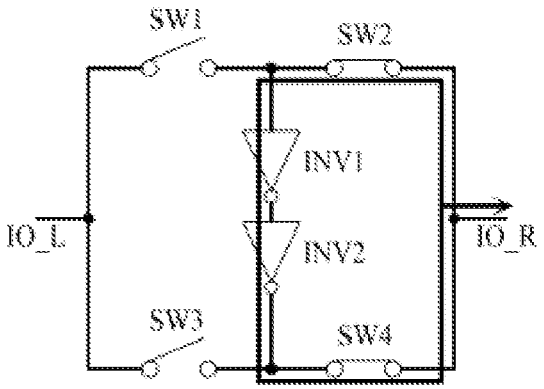
FIGS. 7A and 7B are diagrams illustrating a bi-directional latch operation of the bi-directional deskew buffer (BDB) according to one embodiment.
Figure 7B:
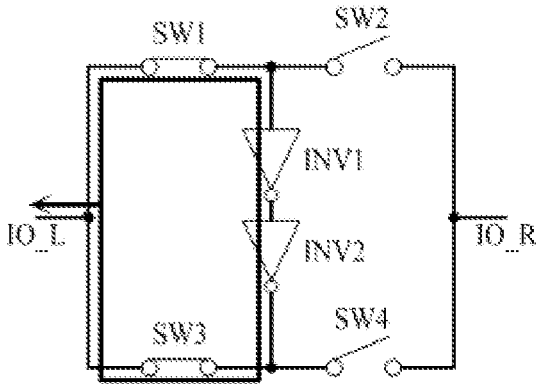

FIG. 5 is an equivalent circuit diagram illustrating an internal configuration of a BDB according to one embodiment, and FIGS. 6A and 6B are diagrams illustrating a bi-directional buffering operation of the BDB according to one embodiment, and FIGS. 7A and 7B are diagrams illustrating a bi-directional latch operation of the BDB according to one embodiment.

Referring to FIG. 5, the BDB according to one embodiment may include an input switch part 710 including first and second switches SW1 and SW2, an output switch part 730 including third and fourth switches SW3 and SW4, and a buffer part 720 including first and second inverters INV1 and INV2 between the input switch part 710 and the output switch part 730. An switching operation of each of the first to fourth switches SW1, SW2, SW3, and SW4 may be controlled by the logic controllers 640A and 640B (640). The internal circuit configuration of the BDB may be applied to each of the clock buffer and the data buffer part, and in this case, the input switch part 710 of the data buffer may be controlled by an output of the clock buffer. The data buffer part of one channel includes data buffers of a plurality of bits, which buffer and latch pieces of data of a plurality of bits in parallel, and the data buffer of each bit may be configured as an internal circuit illustrated in FIG. 5.

The first and second switches SW1 and SW2 of the input switch part 710 may be connected in series between first and second supply lines IO_L and IO_R, and may determine an input direction or a latch operation.

The third and fourth switches SW3 and SW4 of the output switch part 730 may be connected in series between the first and second supply lines IO_L and IO_R, and may determine an output direction or the latch operation.

The first and second inverters INV1 and INV2 of the buffer part 720 may be connected in series between a first connection node N1 between the first and second switches SW1 and SW2 and a second connection node N2 between the third and fourth switches SW3 and SW4, and may buffer and output an input signal or may latch and output the input signal.

Referring to FIG. 6A, when the first and fourth switches SW1 and SW4 are turned-on, and the second and third switches SW2 and SW3 are turned-off, the input signal supplied through the left first supply line IO_L may be buffered through a first path passing through the first switch SW1, the first and second inverters INV1 and INV2, and the fourth switch SW4 in a first direction and output through the right second supply line IO_R.

Referring to FIG. 6B, when the first and fourth switches SW1 and SW4 are turned-off, and the second and third switches SW2 and SW3 are turned-on, the input signal supplied through the right second supply line IO_R may be buffered through a second path passing through the second switch SW2, the first and second inverters INV1 and INV2, and the third switch SW3 in a second direction and output through the left first supply line IO_L.

When the first and fourth switches SW1 and SW4 are turned-on and the second and third switches SW2 and SW3 are turned-off as shown in FIG. 6A, and then the first and third switches SW1 and SW3 are turned-off and the second and fourth switches SW2 and SW4 are turned-on as shown in FIG. 7A, the input signal supplied through the left first supply line IO_L may be buffered through the first path passing through the first switch SW1, the first and second inverters INV1 and INV2, and the fourth switch SW4 in the first direction as shown in FIG. 6A, and then latched through a third path passing through the second switch SW2, the first and second inverters INV1 and INV2, and the fourth switch SW4, and the latched signal may be output through the right second supply line IO_R.

When the first and fourth switches SW1 and SW4 are turned-off and the second and third switches SW2 and SW3 are turned-on as shown in FIG. 6B and then the second and fourth switches SW2 and SW4 are turned-off and the first and third switches SW1 and SW3 are turned-on as shown in FIG. 7B in response to the control of the logic controllers 640A and 640B (640), the input signal supplied through the right second supply line IO_R may be buffered through the second path passing through the second switch SW2, the first and second inverters INV1 and INV2, and the third switch SW3 in the second direction as shown in FIG. 6B and then latched through a fourth path passing through the first switch SW1, the first and second inverters INV1 and INV2, and the third switch SW3 as shown in FIG. 7B, and the latched signal may be output through the left first supply line IO_L.

Figure 8:
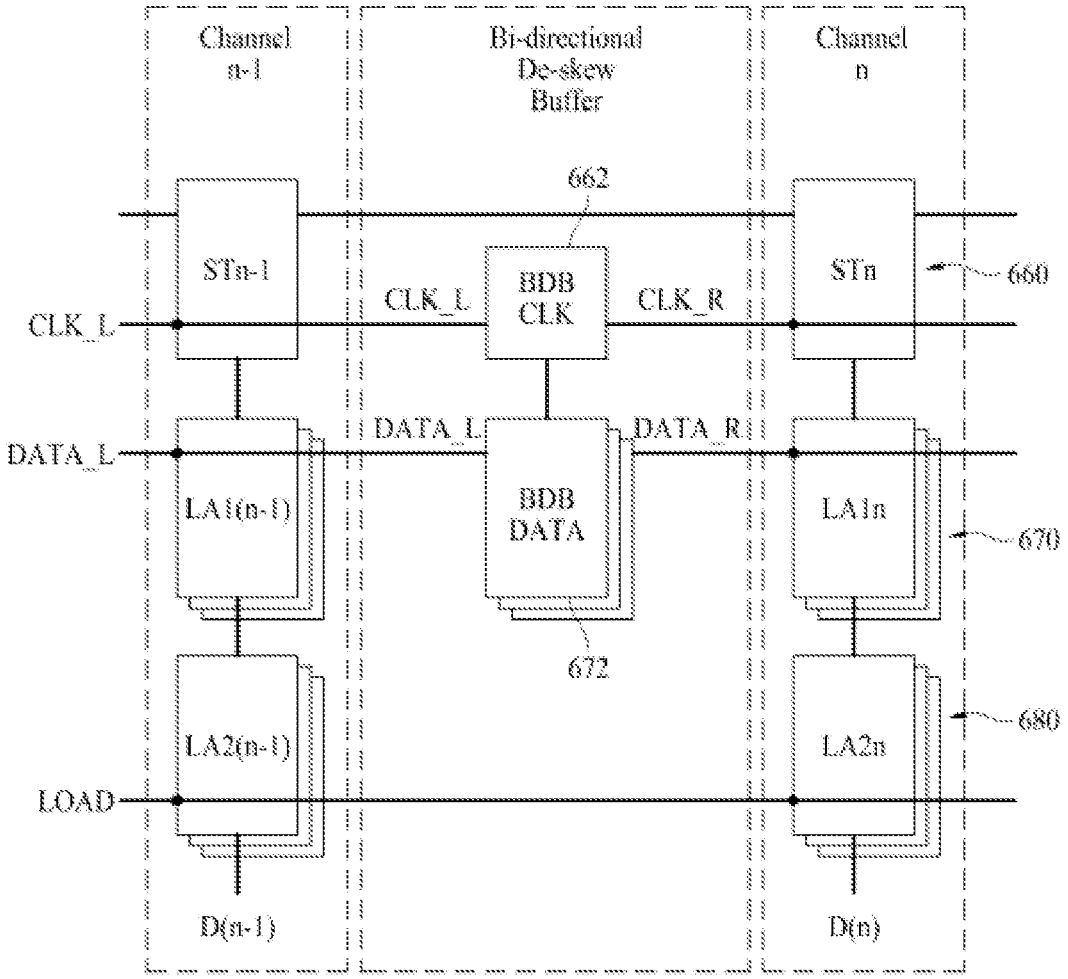
FIG. 8 is a block diagram illustrating a partial configuration of a shift register and a latch part of the data driver IC having a BDB part according to one embodiment.
Figure 9:
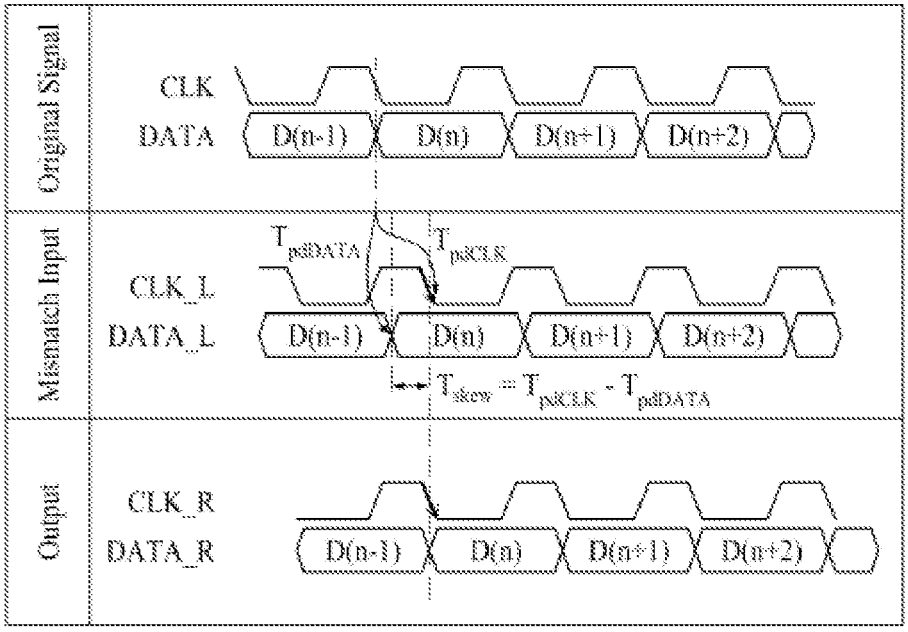
FIG. 9 is a timing diagram illustrating input/output signals of a clock buffer and a data buffer according to one embodiment.

FIG. 8 is a block diagram illustrating a partial configuration of a shift register and a latch part of the data driver IC having the BDB part according to one embodiment, and FIG. 9 is a timing diagram illustrating input/output signals of a clock buffer and a data buffer according to one embodiment.

Referring to FIG. 8, the BDB part according to one embodiment may include a clock buffer 662, which is disposed on a clock line between a stage STn−1 of an (n−1)th (n is an integer greater than or equal to 2) channel and a stage STn of an nth channel in the shift register 660, and a data buffer part 672 disposed on a data bus between a first latch LA1(*n*−1) of the (n−1)th channel and a first latch LA1*n* of the nth channel in the first latch part 670.

The clock buffer 662 of the BDB part may buffer an input clock CLK_L supplied through the stage STn−1 of the (n−1)th channel, and supply a buffered clock CLK_R to the stage STn of the nth channel as a clock signal.

The data buffer part 672 of the BDB part may buffer and latch data of the nth channel, which is transmitted after data of the (n−1)th channel through the data bus passes through the first latch LA1(*n*−1) of the (n−1)th channel, in synchronization with the output clock CLK_R of the clock buffer 662, and supply the data of the nth channel, which is synchronized with the output clock CLK_R of the clock buffer 662, to the first latch LA1*n* of the nth channel. The data buffer part 672 of the BDB part may include k-bit data buffers 672 (k is a positive integer) that respectively buffer and latch k bits of the corresponding channel (sub-pixel) data and output the latched k bits.

In the shift register 660, the stage STn−1 of the (n−1)th channel may output the sampling signal of the (n−1)th channel to the first latch LA1(*n*−1) of the (n−1)th channel in response to the input clock CLK_L, and the stage STn of the nth channel may output the sampling signal to the first latch LA1*n* of the nth channel in response to the clock CLK_R buffered through the clock buffer 662.

The first latch LA1(*n*−1) of the (n−1)th channel may sample and latch the data of the (n−1)th channel in response to the sampling signal supplied from the stage STn−1 of the (n−1)th channel. The first latch LA1*n* of the nth channel may sample and latch data DATA_R of the nth channel, which is supplied through the data buffer 672, in response to the sampling signal supplied from the stage STn of the nth channel. The first latch LA1*n* of each channel may include k bit first latches for respectively latching k bits of each sub-pixel.

Second latches LA2(*n*−1) and LA2*n* of the (n−1)th and nth channels of the second latch part 680 may simultaneously receive and latch data signals from the first latches LA1(*n*−1) and LA1*n* of the (n−1)th and nth channels in response to a load signal LOAD, which is a second latch enable signal, and simultaneously output the latched data signals. The second latch LA2*n* of each channel may include k bit second latches for respectively latching k bits of each sub-pixel.

Referring to FIG. 9, a clock CLK input to the shift register 660 and data DATA input to the first latch part 670, which are input as original signals, are supplied such that a pull-down timing $T_{pdcLK}$ of the clock CLK is synchronized with a pull-down timing $T_{pdDATA}$ of each of pieces of data D(n−1), D(n), D(n+1), and D(n+2).

As the B data path is longer in the channel area 650, in a clock CLK_L input to the shift register 660 of the corresponding channel and data DATA_L input to the first latch part 670, a skew ($Tskew=T_{pdcLK}-T_{pdDATA}$), in which the pull-down timing $T_{pdcLK}$ of the clock CLK mismatches the pull-down timing $T_{pdDATA}$ of each of the pieces of data D(n−1), D(n), D(n+1), and D(n+2), may occur.

However, by using the clock buffer 662 and the data buffer part 672 of the BDB part according to one embodiment, the data buffer part 672 may buffer and latch the input data DATA_L of the corresponding channel, and supply latched data DATA_R of the corresponding channel to the corresponding channel of the first latch part 670 so as to be synchronized with the output clock CLK_R of the clock buffer 662. Accordingly, the clock buffer 662 and the data buffer part 672 of the BDB part may offset timing mismatch by correcting the skew due to a variation between the pull-down timing $T_{pdCLK}$ of the clock CLK and the pull-down timing $T_{pdDATA}$ of each of the pieces of data D(n−1), D(n), D(n+1), and D(n+2).

As described above, in the data driver IC 600 according to one embodiment, the BDB may serve as a bi-directional buffer and simultaneously as a latch to offset the skew between the clock and the data, which may occur due to high-frequency driving of the B data path passing through the logic controllers 640A and 640B and the channel area 650, that is, timing mismatching.

In addition, in the data driver IC 600 according to one embodiment, since the BDB part serves as a bi-directional buffer, an optimal arrangement for shortening the A data path with the highest driving frequency, that is, adjacent arrangement (FIG. 4) of the receivers 630A and 630B and the logic controllers 640A and 640B may be realized, thereby overcoming the frequency limitation.

Furthermore, the data driver IC 600 according to one embodiment may sequentially enable and activate the channels of the shift register and the first latch part and the BDB part in units of channel blocks using an output of the BDB part, and when all the channels are enabled and activated, the data driver IC 600 may disable and inactivate the channels, thereby reducing power consumption and reducing electromagnetic interference (EMI). A detailed description thereof will be made below.

Figure 10:
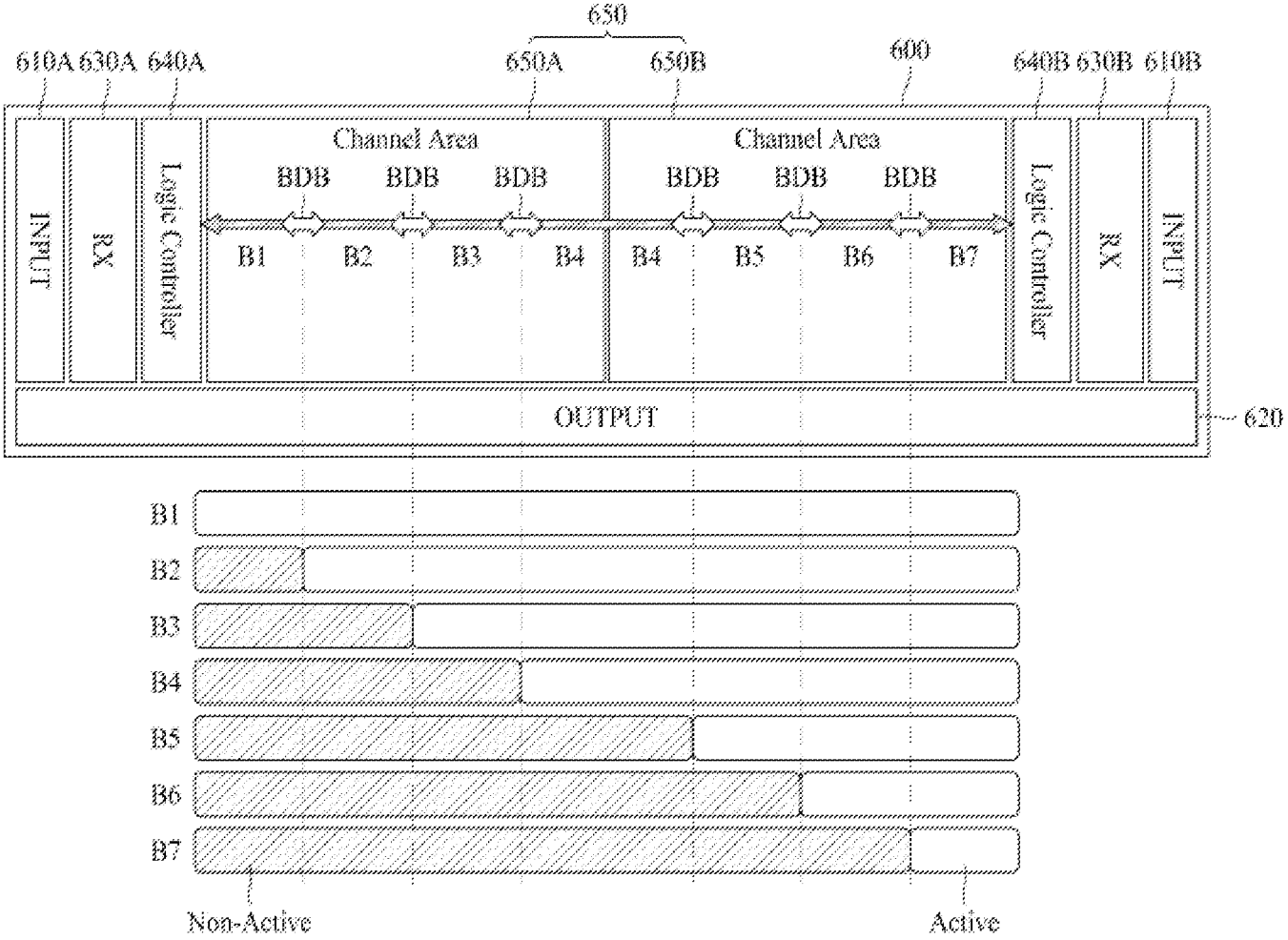
FIG. 10 is a diagram illustrating a principle of reducing power consumption of the data driver IC according to one embodiment.

FIG. 10 is a diagram illustrating a principle of reducing power consumption of the data driver IC according to one embodiment.

Referring to FIG. 10, in the data driver IC 600, the channel area 650 may be divided into a plurality of channel blocks B1 to B7 based on a plurality of BDB parts.

For example, during each active period of a horizontal period, pieces of data of a plurality of channels, which are sequentially supplied to the channel area 650 from the first logic controller 640A, may be sequentially latched for each channel in the first latch part 670 through the B data path in a shift direction (the first direction) of the shift register 660.

First, first latches of a first channel block B1 may sequentially latch data of the first channel block B1 for each channel in response to a sampling signal sequentially output from the shift register of the first channel block B1 as the first channel block B1 becomes an active state. At this point, a shift register and first latches of each of second to seventh channel blocks B2 to B7 are in a non-active state.

When the BDB part between the first and second channel blocks B1 and B2 is activated to output a clock and data of the corresponding channel, the second channel block B2 is additionally activated following the first channel block B1, and the first latches of the second channel block B2 may sequentially latch the data of the second channel block B2 for each channel in response to the sampling signal sequentially output from the shift register of the second channel block B2. At this point, the shift register and the first latches of each of the third to seventh channel blocks B3 to B7 after the second channel block B2 maintain a non-active state.

When the BDB part between the second and third channel blocks B2 and B3 is activated to output a clock and data, the third channel block B3 is additionally activated following the first and second channel blocks B1 and B2, and the first latches of the third channel block B3 may sequentially latch the data of the third channel block B3 for each channel in response to the sampling signal sequentially output from the shift register of the third channel block B3. At this time, the shift register and the first latches of each of the fourth to seventh channel blocks B4 to B7 after the third channel block B3 maintain a non-active state.

When the BDB part between the third and fourth channel blocks B3 and B4 is activated to output a clock and data, the fourth channel block B4 is additionally activated following the first to third channel blocks B1 to B3, and the first latches of the fourth channel block B4 may sequentially latch the data of the fourth channel block B4 for each channel in response to the sampling signal sequentially output from the shift register of the fourth channel block B4. At this point, the shift register and the first latches of each of the fifth to seventh channel blocks B5 to B7 are in a non-active state.

When the BDB part between the fourth and fifth channel blocks B4 and B5 is activated to output a clock and data, the fifth channel block B5 is additionally activated following the first to fourth channel blocks B1 to B4, and the first latches of the fifth channel block B5 may sequentially latch the data of the fifth channel block B5 for each channel in response to the sampling signal sequentially output from the shift register of the fifth channel block B5. At this point, the shift register and the first latches of each of the sixth to seventh channel blocks B6 to B7 are in a non-active state.

When the BDB part between the fifth and sixth channel blocks B5 and B6 is activated to output a clock and data, the sixth channel block B6 is additionally activated following the first to fifth channel blocks B1 to B5, and the first latches of the sixth channel block B6 may sequentially latch the data of the sixth channel block B6 for each channel in response to the sampling signal sequentially output from the shift register of the sixth channel block B6. At this point, the shift register and the first latches of the seventh channel block B7 are in a non-active state.

When the BDB part between the sixth to seventh channel blocks B6 to B7 is activated to output a clock and data, all of the first to seventh channel blocks B1 to B7 are activated, and the first latches of the seventh channel block B7 may sequentially latch the data of the seventh channel block B7 for each channel in response to the sampling signal sequentially output from the shift register of the seventh channel block B7.

As described above, the first latch part of each of the first to seventh channel blocks B1 to B7 may sequentially latch the data of the corresponding channel and output all pieces of the latched data to the second latch part, and then all the BDB parts are inactivated in response to the load signal of the second latch part, and both the shift register and the first latch part of each of the first to seventh channel blocks B1 to B7 are inactivated.

As described above, the B data path supplied to the channel area 650 from the logic controllers 640A and 640B of the data driver IC according to one embodiment is sequentially activated in units of channel blocks in response to the control of the plurality of BDB parts, and maintains a non-active state before the corresponding channel block is activated, thereby reducing power consumption and EMI.

Figure 11:
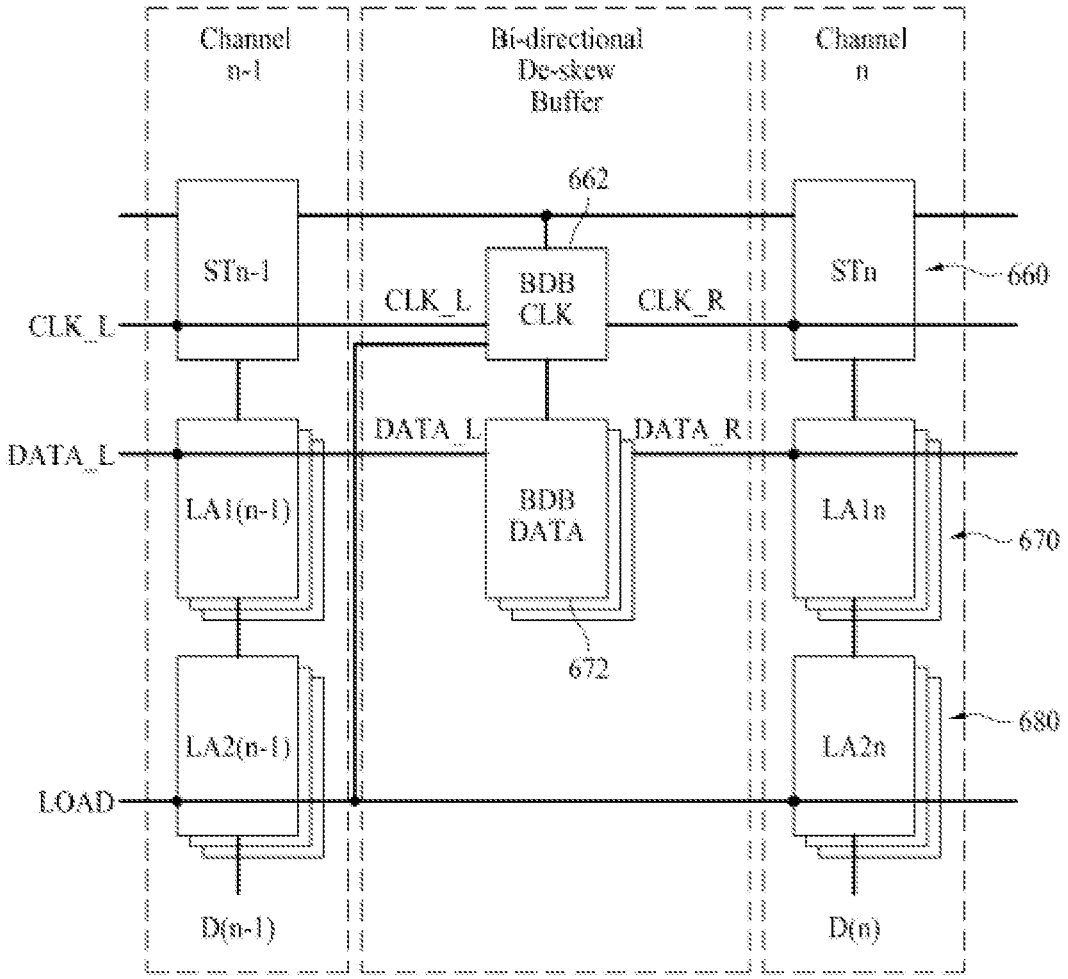
FIG. 11 is a block diagram illustrating a partial configuration of a shift register and a latch part of a data driver IC according to one embodiment.
Figure 12:
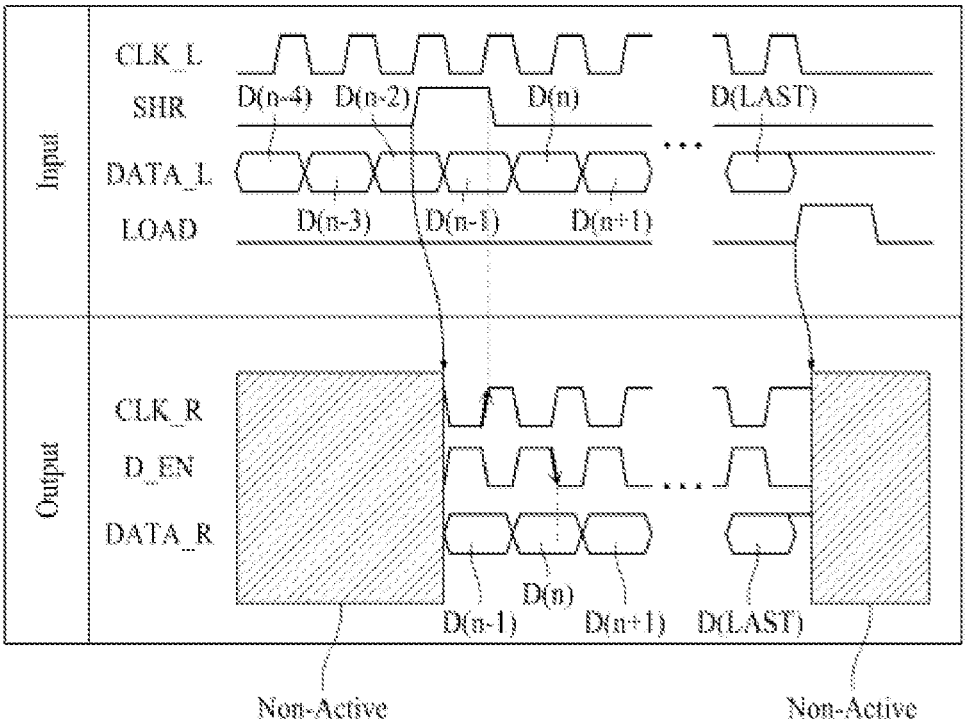
FIG. 12 is a timing diagram illustrating input/output signals of a BDB part in a non-active state and an active state in the data driver IC according to one embodiment.

FIG. 11 is a block diagram illustrating a partial configuration of a shift register and a latch part of a data driver IC according to one embodiment, and FIG. 12 is a timing diagram illustrating input/output signals of a BDB part in a non-active state and an active state in the data driver IC according to one embodiment.

A BDB part illustrated in FIG. 11 is different from the BDB part illustrated in FIG. 8 in that a clock buffer 662 further receives a carry signal SHR of a previous stage STn−1 and a load signal LOAD of a second latch part 680 to control a data buffer part 672, and thus these differences will be mainly described, and descriptions of components overlapping those of FIG. 8 will be omitted or simply described.

Referring to FIGS. 11 and 12, the clock buffer 662 may be enabled in response to the carry signal SHR of the previous stage STn−1, and may buffer the input clock CLK_L supplied from the previous stage STn−1, and then output the buffered output clock CLK_R to a next stage STn. The clock buffer 662 may be disabled in response to the load signal LOAD of the second latch part 680, which is generated after the first latch part 670 outputs all pieces of the latched data to the second latch part 680, and then wait for a next enable state.

The clock buffer 662 may generate a data enable signal D_EN by phase-inverting the output clock CLK_R and output the generated data enable signal D_EN to the data buffer part 672.

The data buffer part 672 may be enabled and activated, or disabled and inactivated according to the data enable signal D_EN received from the clock buffer 662. When the data enable signal D_EN is enabled in response to the carry signal SHR of the previous stage STn−1, the data buffer part 672 may be activated to buffer and latch data of an nth channel, which is supplied through a data bus passing through a first latch part LA1(*n*−1) of an (n−1)th channel, and output the latched data to a first latch LA1*n* of the nth channel. When the data enable signal D_EN is disabled in response to the load signal LOAD of the second latch part 680, the data buffer part 672 may be inactivated.

Figure 13:
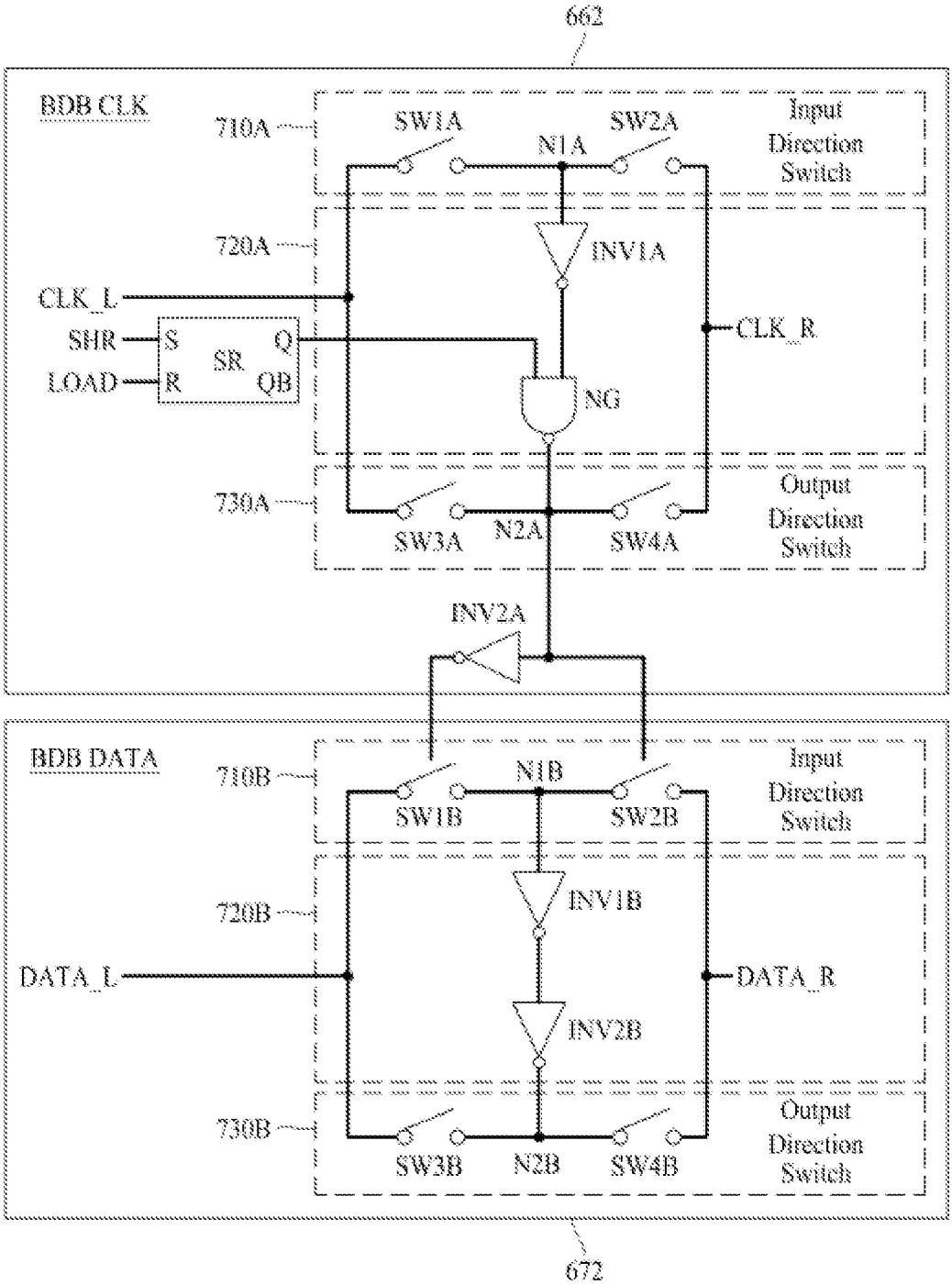
FIG. 13 is an equivalent circuit diagram illustrating an internal configuration of a clock buffer and a data buffer according to one embodiment.

FIG. 13 is an equivalent circuit diagram illustrating an internal configuration of the clock buffer and the data buffer of the BDB part according to one embodiment.

Referring to FIG. 13, the BDB part according to one embodiment includes the clock buffer 662 and the data buffer 672.

The clock buffer 662 may include an input switch part 710A including first and second switches SW1A and SW2A, an output switch part 730A including third and fourth switches SW3A and SW4A, a buffer part 720A including a first inverter INV1A and a NAND gate circuit NG that are connected between a first connection node N1A of the input switch part 710A and second connection node N2A of the output switch part 730A. The clock buffer 662 further includes a SR latch circuit SR that receives the carry signal SHR supplied from the previous stage STn−1 (see FIG. 11) of the shift register and the load signal LOAD supplied to the second latch part 680 (FIG. 11) respectively as a set signal S and a reset signal R, and a second inverter INV2A that inverts an output of the NAND gate circuit NG, which is supplied to the second node N2A of the output switch part 730A, to generate a data enable signal D_EN and supplies the data enable signal D_EN to an input switch part 7106 of the data buffer 672.

In the clock buffer 662, the first and second switches SW1A and SW2A of the input switch part 710A may be connected in series between first and second supply lines IO_L and IO_R, and may determine an input direction in response to the control of the logic controllers 640A and 640B (640).

The third and fourth switches SW3A and SW4A of the output switch part 730A in the clock buffer 662 are connected in series between the first and second supply lines IO_L and IO_R, and may determine an output direction in response to the control of the logic controllers 640A and 640B (640).

The clock buffer 662 may perform a clock buffering operation in a first direction when the first and fourth switches SW1A and SW4A are turned-on, or may perform a clock buffering operation in a second direction opposite to the first direction when the second and third switches SW2A and SW3A are turned-on.

In the clock buffer 662, the SR latch circuit SR may receive the carry signal SHR supplied from the previous stage STn−1 (FIG. 11) of the shift register as the set signal S and receive the load signal LOAD supplied to the second latch part 680 (FIG. 11) as the reset signal R, output an enable signal to the NAND gate circuit NG through an output terminal Q in response to the set signal S, and output a disable signal to the NAND gate circuit NG through the output terminal Q in response to the reset signal R.

In the clock buffer 662, the first inverter INV1A and the NAND gate circuit NG of the buffer part 720 may be connected in series between the first connection node N1A between the first and second switches SW1A and SW2A, and the second connection node N2A between the third and fourth switches SW3A and SW4A, and may buffer and output the input clock CLK_L or disable the output clock CLK_R.

In the clock buffer 662, when the SR latch circuit SR supplies the enable signal in response to the carry signal SHR supplied from the previous stage STn−1 (FIG. 11), the NAND gate circuit NG may buffer the input clock CLK_L together with the first inverter INV1A to supply the output clock CLK_R through the second connection node N2A. At this point, the second inverter INV2A may phase-invert the output clock CLK_R supplied through the second connection node N2A, and output the data enable signal D_EN, which alternates between an enable state and a disabled state in synchronization with the output clock CLK_R, to the input switch part 710B of the data buffer 672.

When the SR latch circuit SR supplies the disabled signal in response to the load signal LOAD of the second latch part 680 (FIG. 11), the NAND gate circuit NG may disable the output clock CLK_R. In this case, the second inverter INV2A may output the data enable signal D_EN in a disabled state supplied through the second connection node N2A to the input switch part 710B of the data buffer 672.

The data buffer 672 may include the input switch part 710B including first and second switches SW1B and SW2B, an output switch part 730B including third and fourth switches SW3B and SW4B, and a buffer part 720B including first and second inverters INV1B and INV2B between the input switch part 710B and the output switch part 730B.

In the data buffer 672, the first and second switches SW1B and SW2B of the input switch part 710B may be connected in series between first and second supply lines IO_L and IO_R, and may determine an input direction or determine a latch operation in response to the data enable signal D_EN supplied from the clock buffer 662. The first switch SW1B is controlled by the data enable signal D_EN, which is the output of the second inverter INV2A of the clock buffer 662, and the second switch SW2B may be controlled by the input signal of the second inverter INV2A supplied from the second connection node N2A of the clock buffer 662.

In the data buffer 672, the third and fourth switches SW3B and SW4B of the output switch part 730B may be connected in series between the first and second supply lines IO_L and IO_R, and may determine an output direction or the latch operation in response to the control of the logic controllers 640A and 640B (640).

In the data buffer 672, the first and second inverters INV1B and INV2B of the buffer part 720B may be connected in series between the first connection node N1B between the first and second switches SW1B and SW2B, and the second connection node N2B between the third and fourth switches SW3B and SW4B, and may buffer and output the input data DATA_L.

In the data buffer 672, when the first and fourth switches SW1B and SW4B are turned-on and then the second and fourth switches SW2B and SW4B are turned-on, the input data supplied through the left first supply line IO_L may be buffered through a first path passing through the first switch SW1B, the inverters INV1B and INV2B, and the fourth switch SW4B in a first direction, and then latched through a third path passing through the second switch SW2B, the inverters INV1B and INV2B, and the fourth switch SW4B, and output through the right second supply line IO_R.

In the data buffer 672, when the second and third switches SW2B and SW3B are turned-on and then the first and third switches SW1B and SW3B are turned-on, the input data supplied through the right second supply line IO_R may be buffered through a second path passing through the second switch SW2B, the inverters INV1B and INV2B, and the third switch SW3B in a second direction, and then latched through a fourth path passing through the first switch SW1B, the inverters INV1B and INV2B, and the third switch SW3B, and output through the left first supply line IO_L.

As described above, in the data driver IC 600 according to one embodiment, the BDB part may serve as the bi-directional buffer and simultaneously as the latch to offset a skew between the clock and the data, which may occur due to high-frequency driving of the B data path passing through the logic controllers 640A and 640B and the channel area 650, that is, timing mismatching.

In addition, in the data driver IC 600 according to one embodiment, since the BDB part serves as the bi-directional buffer, an optimal arrangement for shortening the A data path with the highest driving frequency, that is, adjacent arrangement of the receivers 630A and 630B and the logic controllers 640A and 640B may be realized, thereby overcoming the frequency limitation.

Furthermore, the data driver IC 600 according to one embodiment may reduce power consumption and EMI by partially enabling and activating, or disabling and inactivating the channels of the first latch part using the output of the BDB part.

As described above, the data driver circuit according to one embodiment may prevent timing mismatching between the clock and the data even when the frequency and the number of channels are increased by correcting the skew between the clock and the data using the clock buffer and the data buffer of the BDB part disposed between adjacent channel blocks for each of the plurality of channel blocks, thereby overcoming a frequency limit and securing a degree of freedom to overcome a design limit.

The data driver circuit according to one embodiment may be configured as a minimum circuit by using the clock buffer and the data buffer of the BDB part disposed between adjacent channel blocks, so that there is no burden on an increase in a chip area, and current consumption may be reduced and EMI may be minimized by activating the channels only when necessary.

The data driver circuit and the display device including the same according to the embodiment may be applied to various electronic devices. For example, the data driver circuit and the display device including the same according to the embodiment may be applied to a mobile device, a video phone, a smart watch, a watch phone, a wearable device, a foldable device, a rollable device, a bendable device, a flexible device, a curved device, an electronic notebook, an e-book, a portable multimedia player (PMP), a personal digital assistant (PDA), an MPEG audio layer-3 player, a mobile medical device, a desktop personal computer (PC), a laptop PC, a netbook computer, a workstation, a navigation device, a vehicle navigation device, a vehicle display device, a television, a wallpaper display device, a signage device, a game device, a notebook computer, a monitor, a camera, a camcorder, a home appliance, and the like.

Features, structures, effects, etc. described above in various examples of the present disclosure are included in at least one example of the present disclosure and are not necessarily limited to only one example. Furthermore, features, structures, effects, etc. illustrated in at least one example of the present disclosure may be combined or modified for other examples by those skilled in the art to which the technical idea of the present disclosure pertains. Therefore, the contents related to such combinations and modifications should be interpreted as being included in the technical spirit or scope of the present disclosure.

While the present disclosure described above is not limited to the above-described embodiments and the accompanying drawings, it will be apparent to those skilled in the art to which the present disclosure belongs that various substitutions, modifications, and changes may be made herein without departing from the scope of the present disclosure. Therefore, the scope of the present disclosure is defined by the appended claims, and all changes or modifications derived from the meaning, scope, and equivalence of the claims are to be construed as being included in the scope of the present disclosure.

What is claimed is:

1. A data driver circuit comprising:

a shift register configured output sampling signals in response to a clock;

a first latch circuit configured to sample and latch data of a channel in response to each of the sampling signals; and a bi-directional deskew buffer circuit disposed between a first stage and a second stage of the shift register and between a first latch of a first channel and a first latch of a second channel of the first latch circuit, and configured to buffer a clock input from the first stage of the shift register to output the buffered clock to the second stage of the shift register, and buffer and latch input data of the second channel in synchronization with the buffered clock to output the latched data to the first latch of the second channel, wherein, the shift register and the first latch circuit are divided into a plurality of channel blocks, the bi-directional deskew buffer circuit is disposed between the plurality of channel blocks, the plurality of channel blocks of the shift register and the first latch circuit, and the bi-directional deskew buffer circuit between the plurality of channel blocks, are sequentially activated from an inactivated state, and when the first latch circuit latches all pieces of data of the plurality of channel blocks, the plurality of channel blocks and the bi-directional deskew buffer circuit are inactivated.

2. The data driver circuit of claim 1, wherein the bi-directional deskew buffer circuit includes:

a clock buffer configured to buffer the clock supplied from the first stage of the shift register and output the buffered clock to the second stage of the shift register; and a data buffer circuit configured to buffer and latch the input data of the second channel in synchronization with the clock output from the clock buffer, and output the latched data to the first latch of the second channel.

3. The data driver circuit of claim 2, wherein each of the clock buffer, and data buffers of a plurality of bits constituting the data buffer circuit includes:

an input switch circuit including a first switch and a second switch connected in series between a first supply line and a second supply line and configured to determine an input direction or a latch operation;

an output switch circuit including a third switch and a fourth switch connected in series between the first and second supply lines and configured to determine an output direction or the latch operation; and a buffer circuit connected between a first connection node between the first and second switches and a second connection node between the third and fourth switches, wherein the first supply line of the clock buffer is connected to the first stage, the second supply line of the clock buffer is connected to the second stage, the first supply line of the data buffer is connected to the first latch of the first channel, and the second supply line of the data buffer is connected to the first latch of the second channel.

4. The data driver circuit of claim 3, wherein the clock buffer is configured to:

perform a clock buffering operation in a first direction passing through the first supply line, the turned-on first switch, the buffer circuit, the turned-on fourth switch, and the second supply line; or perform a clock buffering operation in a second direction passing through the second supply line, the turned-on second switch, the buffer circuit, the turned-on third switch, and the first supply line.

5. The data driver circuit of claim 3, wherein each of the data buffers of a plurality of bits is configured to:

perform a data buffering operation in a first direction passing through the first supply line, the turned-on first switch, the buffer circuit, the turned-on fourth switch, and the second supply line, and a latch operation of a first path passing through the turned-on second switch, the buffer circuit, the turned-on fourth switch, and the second supply line; or perform a data buffering operation in a second direction passing through the second supply line, the turned-on second switch, the buffer circuit, the turned-on third switch, and the first supply line, and a latch operation of a second path passing through the turned-on first switch, the buffer circuit, the turned-on third switch, and the first supply line.

6. The data driver circuit of claim 1, further comprising a second latch circuit configured to receive and latch pieces of data of a plurality of channels, which are latched in the first latch circuit, and output the latched pieces of data in response to a load signal, wherein the clock buffer of the bi-directional deskew buffer circuit is enabled in response to a carry signal received from the first stage of the shift register and is disabled in response to the load signal of the second latch circuit, and the data buffer part circuit the bi-directional deskew buffer circuit is enabled or disabled according to an output of the clock buffer.

7. The data driver circuit of claim 6, wherein the clock buffer includes:

an input switch circuit including a 1Ath switch and a 2Ath switch connected in series between a first clock supply line connected to the first stage of the shift register and a second clock supply line connected to the second stage of the shift register;

an output switch circuit including a 3Ath switch and a 4Ath switch connected in series between the first and second clock supply lines;

a buffer circuit connected between a 1Ath connection node between the 1Ath and 2Ath switches and a 2Ath connection node between the 3Ath and 4Ath switches; and an SR latch circuit configured to receive and latch the carry signal received from the stage of the first channel and the load signal respectively as a set signal and a reset signal and output the set signal and the reset signal to the buffer circuit.

8. The data driver circuit of claim 7, wherein the buffer circuit of the clock buffer includes:

a 1Ath inverter connected to the 1Ath connection node; and a NAND gate circuit configured to receive an output of the 1Ath inverter and an output of the SR latch circuit, perform a NAND gate logic operation, and output an operation result to the 2Ath connection node.

9. The data driver circuit of claim 8, wherein the clock buffer further includes a 2Ath inverter configured to receive an output of the 2Ath connection node, generate a data enable signal, and output the data enable signal to the data buffer.

10. The data driver circuit of claim 9, wherein each of the data buffers of a plurality of bits constituting the data buffer circuit includes:

an input switch circuit including a 1Bth switch and a 2Bth switch connected in series between a first data supply line connected to a data bus passing through the first latch of the first channel and a second data supply line connected to the first latch of the second channel;

an output switch circuit including a 3Bth switch and a 4Bth switch connected in series between the first and second data supply lines; and a buffer circuit including a 1Bth inverter and a 2Bth inverter connected in series between a 1Bth connection node between the 1Bth and 2Bth switches and a 2Bth connection node between the 3Bth and 4Bth switches.

11. The data driver circuit of claim 10, wherein the data enable signal output from the clock buffer controls the 1Bth switch of the data buffer, and a signal output from the 1Bth connection node of the clock buffer controls the 2Bth switch of the data buffer.

12. The data driver circuit of claim 1, comprising:

a channel area in which the shift register, the first latch circuit, the bi-directional deskew buffer circuit, a second latch circuit connected to the first latch circuit, a digital-to-analog converter connected to the second latch circuit, and an output buffer circuit connected to the digital-to-analog converter are disposed;

an output pad area configured to output data signals supplied from the channel area to a plurality of output channels;

an input pad area configured to receive a transmission signal;

a receiver disposed adjacent to the input pad area, and configured to receive the transmission signal through the input pad area, and recover the clock, the data, and a control signal from the received transmission signal to output the recovered clock, data, and control signal; and a logic controller disposed adjacent to and between the receiver and the channel area, and configured to transmit the clock and the control signal supplied from the receiver to the channel area and rearrange the data for each channel to supply the data to the channel area.

13. The data driver circuit of claim 12, wherein the logic controller includes a first logic controller and a second logic controller disposed respectively adjacent to both side surface portions of the channel area with the channel area therebetween, the receiver includes a first receiver and a second receiver disposed respectively adjacent to the first and second logic controllers, the input pad area includes a first input pad area and a second input pad area disposed on both side surface portions of the data driver circuit to be adjacent to the first and second receivers, respectively, and the output pad area is located at a lower end portion of each of the input pad area, the receiver, the logic controller, and the channel area.

14. The data driver circuit of claim 13, wherein a signal is transmitted in a first direction of the channel area through the first input pad area, the first receiver, and the first logic controller according to a driving option, or the signal is transmitted in a second direction of the channel area through the second input pad area, the second receiver, and the second logic controller according to the driving option.

15. A data driver circuit comprising:

a bi-directional deskew buffer circuit disposed between a first stage and a second stage of a shift register and between a first latch of a first channel and a first latch of a second channel of a first latch circuit, wherein the bi-directional deskew buffer circuit includes:

a clock buffer configured to buffer a clock input from the first stage of the shift register and output the buffered clock to the second stage of the shift register; and a data buffer circuit configured to buffer and latch input data of the second channel in synchronization with a clock output from the clock buffer, and output the latched data to the first latch of the second channel, wherein each of the clock buffer, and data buffers of a plurality of bits constituting the data buffer circuit includes:

an input switch circuit including a first switch and a second switch connected in series between a first supply line and a second supply line and configured to determine an input direction or a latch operation;

an output switch circuit including a third switch and a fourth switch connected in series between the first and second supply lines and configured to determine an output direction or the latch operation; and a buffer circuit connected between a first connection node between the first and second switches and a second connection node between the third and fourth switches, wherein the first supply line of the clock buffer is connected to the first stage, the second supply line of the clock buffer is connected to the second stage, the first supply line of the data buffer is connected to the first latch of the first channel, and the second supply line of the data buffer is connected to the first latch of the second channel.

16. A data driver circuit comprising:

a bi-directional deskew buffer circuit disposed between a first stage and a second stage of a shift register and between a first latch of a first channel and a first latch of a second channel of a first latch circuit; and a second latch circuit configured to receive and latch pieces of data of a plurality of channels, which are latched in the first latch circuit, and output the latched pieces of data in response to a load signal, wherein the bi-directional deskew buffer circuit includes:

a clock buffer configured to buffer a clock input from the first stage of the shift register and output the buffered clock to the second stage of the shift register; and a data buffer circuit configured to buffer and latch input data of the second channel in synchronization with a clock output from the clock buffer, and output the latched data to the first latch of the second channel, wherein the clock buffer is enabled in response to a carry signal received from the first stage of the shift register and is disabled in response to the load signal of the second latch circuit, and the data buffer circuit is enabled or disabled according to an output of the clock buffer.

17. The data driver circuit of claim 16, wherein the clock buffer includes:

an input switch circuit including a 1Ath switch and a 2Ath switch connected in series between a first clock supply line connected to the first stage of the shift register and a second clock supply line connected to the second stage of the shift register;

an output switch circuit including a 3Ath switch and a 4Ath switch connected in series between the first and second clock supply lines;

a buffer circuit connected between a 1Ath connection node between the 1Ath and 2Ath switches and a 2Ath connection node between the 3Ath and 4Ath switches; and an SR latch circuit configured to receive and latch the carry signal received from the first stage and the load signal respectively as a set signal and a reset signal and output the set signal and the reset signal to the buffer circuit, and each of data buffers of a plurality of bits constituting the data buffer circuit includes:

an input switch circuit including a 1Bth switch and a 2Bth switch connected in series between a first data supply line connected to a data bus passing through the first latch of the first channel and a second data supply line connected to the first latch of the second channel;

an output switch circuit including a 3Bth switch and a 4Bth switch connected in series between the first and second data supply lines; and a buffer circuit including a 1Bth inverter and a 2Bth inverter connected in series between a 1Bth connection node between the 1Bth and 2Bth switches and a 2Bth connection node between the 3Bth and 4Bth switches.

* * * * *